United States Patent [19]

Mattuck et al.

[11] 4,373,555

[45] Feb. 15, 1983

[54] CUT-OUT FUSE TUBE

[75] Inventors: Morris Mattuck, La Chute; Rheal Comte, Ste. Marthe-sur-le-Lac, both of Canada

[73] Assignee: Canadian General Electric Company Limited, Toronto, Canada

[21] Appl. No.: 326,548

[22] Filed: Dec. 2, 1981

[51] Int. Cl.[3] ..... D03D 35/00; H01H 85/02

[52] U.S. Cl. ..... 138/140; 138/174; 138/177; 337/158; 337/186; 428/36; 525/438

[58] Field of Search ..... 337/270, 158, 159, 186; 428/36; 138/174, 177, 140; 525/438

[56] References Cited

U.S. PATENT DOCUMENTS

| | | | |
|---|---|---|---|
| 2,976,889 | 3/1961 | Cannady, Jr. | 138/141 |
| 2,991,808 | 7/1961 | Siegmann et al. | 138/141 |
| 3,054,428 | 9/1962 | Crawford | 138/141 |
| 3,435,397 | 3/1969 | Sankey et al. | 337/34 |
| 3,801,947 | 4/1974 | Blewitt et al. | 337/246 |
| 3,846,727 | 11/1974 | Harmon | 337/246 |
| 3,983,525 | 9/1976 | Healey, Jr. | 337/186 |
| 3,986,158 | 10/1976 | Salzer | 337/246 |
| 4,076,767 | 2/1978 | Samejima | 525/438 |
| 4,141,882 | 2/1979 | Kodama et al. | 525/438 |

FOREIGN PATENT DOCUMENTS 645259 7/1962 Canada .

OTHER PUBLICATIONS

ASTM: Tentative Specifications for Vulcanized Fibre Sheets Rods and Tubes used for Electrical Insulation, 1954.

The Arc-Interruption and Gas-Evolution Characteristics of Common Polymeric Materials-8th IEEE/PES Conference-Minneapolis, Sep. 20-25, 1981.

G.E. pamphlet-Current Limiting Fuses on Distribution Systems-1974.

*Primary Examiner*—William R. Dixon, Jr.

*Attorney, Agent, or Firm*—R. A. Eckersley

[57] ABSTRACT

The present invention concerns improvements in the use of polyester materials in arc quenching applications, particularly in the cutout fuse tube industry. In one embodiment of the present invention a fuse tube is disclosed as comprising a laminate two-layered structure including as its inner layer, (or liner), a heat-treated polyester filament winding supported in a cured cycloaliphatic epoxy resin matrix. The outer layer includes wound glass filaments supported within a cured epoxy resin matrix. The heat treatment of the polyester filament substantially improves the mechanical and electrical character of the fuse tube.

20 Claims, 2 Drawing Figures

CUT-OUT FUSE TUBE

The present invention concerns improvements in cut-out fuse tubes disclosed in copending Case 2785-A Bergh.

FIELD OF THE INVENTION

The present invention relates to improvements in the use of cycloaliphatic epoxy-supported polyester materials in arc-quenching applications such as for example, electrical fuse tube manufacture. More particularly, the present invention is concerned with the use of cycloaliphatic epoxy-supported heat-treated-polyester fibre liners in expulsion type fuses such as are used in fuse cut-outs.

Materials having arc-quenching properties suitable for fuse tube applications are known to include, inter alia, reconstituted cellulosic materials (i.e., vulcanized paper fibre and boric acid) and more recently arc extinguishing thermoplastics such as for example the Exarc II TM thermoplastics available from the Dow Chemical Co. (These are molybdenum sulfide filled nylons—see U.S. Pat. No. 3,111,567—V. W. Stewart et al., dated Nov. 19, 1963).

Structural materials known to be useful in the manufacture of fuse tubes include paper, glass cloth, or glass fibre reinforced phenolic resins and epoxy resins, including blends of phenolic resins and glycidyl polyethers or epoxides.

Examples of fuse tubes employing certain of the above-mentioned materials are disclosed in, inter alia, U.S. Pat. No. 3,986,158—Salzer dated Oct. 12, 1976; U.S. Pat. No. 3,846,727—Harmon, dated Nov. 5, 1974; U.S. Pat. No. 3,801,947—Blewitt et al., dated Apr. 2, 1974; and, Canadian Pat. No. 637,266—Cannady, dated Feb. 27, 1962.

The present invention concerns improvements in the production of an alternative to the above-mentioned arc-quenching materials, one that has particular utility in the manufacture of fuse tubes requiring strong, ablative liner materials having improved mechanical and electrical characteristics. As an alternative to the vulcanized paper fibre commonly employed throughout the fuse tube industry the improved material of the present invention offers reduced cost, and improved dimensional stability (owing to and inherently lower tendancy to absorb water) in such fuse tube applications.

SUMMARY OF THE INVENTION

Briefly stated the broadest aspects of the present invention include the provision of a composition for use in arc-quenching applications, comprising heat-treated polyester fibre material supported in a cycloaliphatic epoxy resin matrix. The composition may be applied as an arc-quenching surface layer in, for example, fuse tubes.

Additional structural support may be achieved by adding an external layer or layers of, engineering plastics which may include, interalia, epoxy, phenolic, polyurethane or silicone resins. Preferably, such additional layers are reinforced and glass fibre reinforced epoxy is especially preferred for higher voltage fuse tube applications.

In one embodiment of the present invention there is provided a composition comprising heat treated polyester fibre supported in a cycloaliphatic epoxy resin matrix. The heat treatment of the polyester fibres reduces any tendency these fibres may otherwise have toward post-cure shrinking.

It will be understood that within the context of the present disclosure, the term "cycloaliphatic epoxy resin" will be taken to mean those polymers resulting from epoxidation of polycyclic aliphatic compounds containing carbon-carbon double bonding. The epoxidation of such multicycloalkenyls may be accomplished via organic peracids, such as for example, peracetic acid.

An example of one such cycloaliphatic epoxy resin which is particularly useful in the practice of the present invention is 3,4-epoxy cyclohexy methyl (3,4 epoxy) cyclohexane carboxylate, the structure of which is shown below:

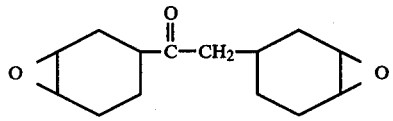

Also, the term "polyester fibre" is used as a generic term meaning any long chain synthetic polymer comprising at least 85 percent by weight of an ester of a dihydric alcohol and terephthalic acid. A typical example of the polyester fibres useful in the practice of the present invention is Dacron TM fibre, a linear polyester fibre derived from polyethylene terephthalate (the reaction product of two successive ester interchange reactions involving dimethyl terephthalate and ethylene glycol). The repeating unit structure for polyethylene terephthalate is shown below:

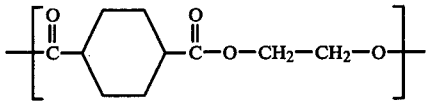

As an alternative to the preferred continuous polyester filaments, it is comtemplated that polyester tapes, cloths, or staple fibres may also be employed in the practice of the present invention.

For example in one alternate embodiment of the present invention, staple heat-treated polyester fibres are embedded in a cycloaliphatic epoxy resin and the resultant composition is pre-formed to the desired shape. In the case of fuse tube manufacturing the formed tube may then be cured, and cut and machined for fuse tube application. Optionally, an additional layer may be applied over the tube either before, as is preferred, or after the curing of the tube. The heat treatment of the polyesters of the present invention improves the mechanical and electrical properties of the arc-quenching material by reducing (or depending on the degree to which the heat treatment is carried-substantially eliminating) any tendancy there might otherwise be for post-cure shrinking in the polyester fibres. It will, of course be understood that the degree of improvement will follow directly as a function of the temperature and the duration of the treatment, and that the manipulation of these parometers to effect the desired degree of result will depend entirely on the application to which the material will ultimately be put (i.e., high or low amperage arc-extinguishing applications, single slot or multiple re-use applications, etc.). Generally, it is preferred that the polyester fibres be pre-heat shrunk to a substantially zero-shrink value.

Any of the embodiments of the present invention can be further improved by any means which effectively enhances the compatibility between the polyester fibre and the cycloaliphatic epoxy resin. For example, surface treatments of available industrial polyester fibres (sizings for example) may be selected to optimize bonding between these fibres and the cycloaliphatic epoxy resin.

In this same respect, mofification of the cycloaliphatic epoxy resin through the use of flexibilizers and fillers is also contemplated.

To further improve the resistance to delamination between the polyester and epoxy materials of the present invention it is also contemplated that multifunctional acids and/or bases could be employed together with certain, known, unsaturated reactants in the manufacture of the polyester fibre material. This would permit chemical cross-linking between the polyester fibre and the thermosetting cycloaliphatic epoxy resin.

Flame retardants may also be advantageously employed in the practice of the present invention. It will be noted however, that the use of certain flame retardants in the polyester fibre-cycloaliphatic epoxy composition may give rise to problems of internal arc over and carbon tracking. Aluminum trihydrate flame retardants minimize these problems, and also provide the additional theoretical advantage that the associated water of hydration may under arc conditions transform any carbon into volatile products.

The incorporation of flame retardants in any additional layers is also desirable. Obviously, the limitations on the selection of flame retardants for such additional layers are not as stringent as for the arc quenching material, however non-halogenated flame retardants are nonetheless preferred.

For a better understanding of the nature and features of the present invention, reference may be made to the following detailed description of the preferred embodiments of the present invention and, in particular, to the examples disclosed hereafter.

DETAILED DESCRIPTION OF THE PREFERRED EMBODIMENT

Where the practice of the present invention is directed to the manufacture of fuse tubes, it is preferred that such fuse tubes be produced via filament winding techniques such as are well established in the existing art.

Under such a manufacturing regime pre-heat shrunk polyester rovings or filaments are wound onto a rotating mandrel concurrent with the application of an uncured curable cycloalkenyl epoxide to form a first layer. This first layer is then overwound with a second layer comprising glass roving, having an epoxy-compatible sizing and an additional amount of the same or different uncured curable cycloalkenyl epoxide.

Optionally, of course, any uncured curable epoxy resin may be employed in place of the additional amount of the cycloalkenyl epoxide, including for example, bispehnol A-epichlorhydrin epoxy resins.

The uncured fuse tube is then cured, preferably under vacuum to remove air bubbles. Curing may be accomplished by any conventional means.

The cured tube is then removed from the mandrel and centerless ground (or otherwise machined) cut to length and painted with a weather resistant paint suitable for fuse tube applications.

It will be understood that where the requirements for strength are not too exacting then the second layer may be omitted and the fuse tube structure may be formed entirely of the material of the first layer.

The following examples will provide a detailed description of some of the compsitions falling within the scope of the present invention. These examples should not, however, be contrued to limit the scope of the present invention in any respect.

EXAMPLE 1

Celanese Type 770 polyester fibre was heat treated at between 375° and 400° F., for a period of time sufficient to preshrink the fibre to a substantially zero shrink value. (i.e. the treated polyester fibre has substantially no tendancy towards any post-cure shrinkage).

Although preimpregnation of the roving offers an alternative approach, the rovings of this example were run from a creel through an Araldite TM (available from Ciba-Geigy) cycloaliphatic epoxy resin bath and wound in a predetermined pattern over a rotating mandrel until the desired amount of material had been deposited in this first layer.

A second layer was then deposited over the first layer by over winding the first layer with filamentous glass fibre having an epoxy-compatible sizing (available from fiberglass Canda Inc.), and an epichlorhydrinbisphenol-A epoxy resin Epon TM 828 (available from Shell Chemicals).

Both of the epoxy resin mentioned above included anhydride hardener and a choline base catalyst.

The wound structures were then cured through a two step curing process comprising a first "gelling" step at about 145° F. and a second "final curing" step at about 400° F.

EXAMPLE 2

A fuse tube was filament wound as in Example 1 but using instead a pre-heat treated Dacron TM polyester (2000 Denier RO-2 type 68 available from Dupont.

EXAMPLE 3

A fuse tube was again filament wound as in Example 1 but substituting the use of a pre-heat treated Celanese polyester Type 811 for Type 770. In addition the Epon TM 828 resin was not employed in the outer layer and instead more of the Araldite TM cycloaliphatic resin was applied with the glass roving.

Particularly advantageous results may be obtained when the polyester fibre material comprises 45 to 60 weight percent of the first layer, the cycloaliphatic epoxy resin comprises from 15 to 25 weight percent of the first layer and the balance comprises hardener catalyst.

BRIEF DESCRIPTION OF THE DRAWINGS

The drawings discussed below are illustrative of preferred embodiments of the present invention, wherein;

FIG. 1 shows a fuse tube 10 having a single layered construction and comprising a pre-heat treated Dacron TM polyester filament winding embedded in an Araldite TM cycloaliphatic epoxy resin and further including glass fibre reinforcement which may optionally be staple or continuous filament in form.

FIG. 2 shows a fuse tube 14 having a first layer 12 and a second layer 16. Layer 12 comprises a pre-heat treated Celanese polyester type 770 embedded in an Araldite TM cycloaliphatic epoxy resin. Layer 16 comprises filament wound glass fibre embedded within an Epon TM 828 epoxy resin. The first layer 12 of an especially preferred embodiment includes 52.5 percent continuous filament polyester fibre, 22 percent cycloaliphatic epoxy resin, 25.4 percent anhydride hardener and 0.1 percent choline base catalyst by weight.

Figure 1:
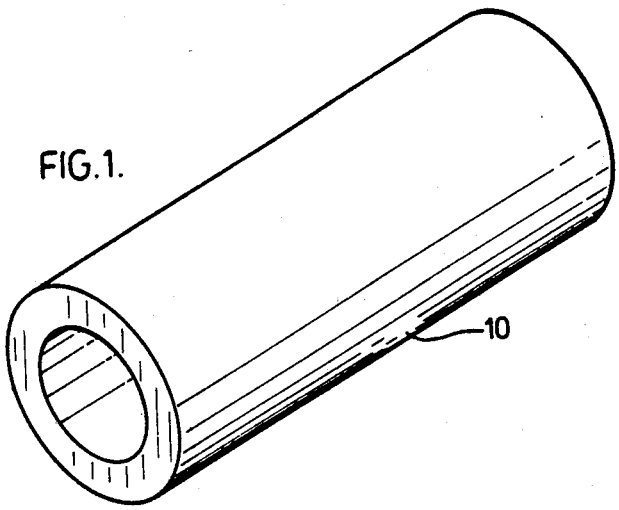
FIG. 1 shows a single layer fuse tube in accordance with the present invention.
Figure 2:
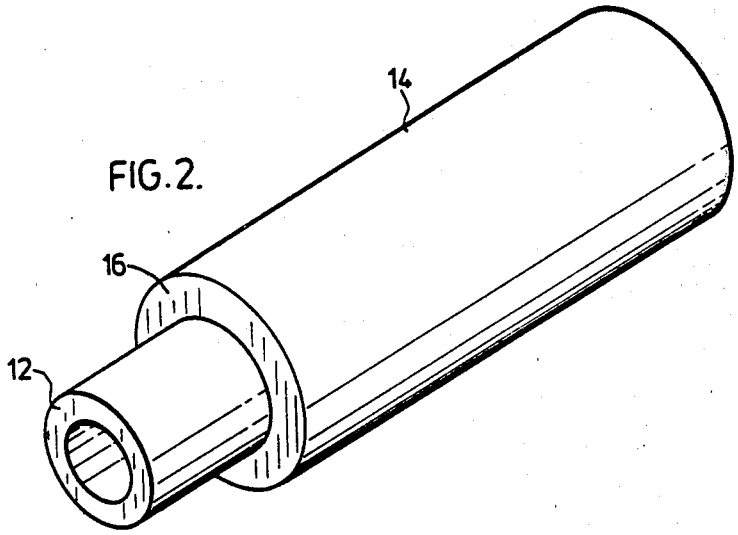
FIG. 2 shows a double layer fuse tube in accordance therewith.

While the foregoing has been a description of preferred embodiments of the present invention, it should be understood that the invention need not be limited thereto. Accordingly, the present invention should be limited only to that which is claimed in the accompanying claims.

What we claim as new and desire to secure by Letters Patent of the United States is:

1. An arc-quenching composition comprising heat-treated polyester fibre material supported in a cycloaliphatic epoxy resin matrix.

2. The composition of claim 1 wherein said heat-treated polyester fibre material is a polyester tape.

3. The composition of claim 1 wherein said heat-treated polyester fibre material is a staple polyester fibre.

4. The composition of claim 1 wherein said heat-treated polyester fibre material is filamentous.

5. The composition of claim 4 wherein said filamentous heat-treated polyester fibre consists of a long chain synthetic polymer comprising at least 85 percent by weight of said filamentous polyester fibre, of an ester of a dimethyl terephthatlate and ethylene glycol, and having repeating units of the formula:

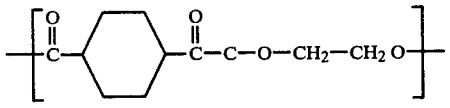

6. A multiple layered laminate having an arc-quenching surface layer comprising a heat-treated polyester fibre material supported in a cycloaliphatic epoxy resin matrix.

7. The laminate of claim 6 wherein at least one of said multiple layers comprises a glass fibre reinforced bisphenol-A epichlorhydrin epoxy resin.

8. The laminate of claim 6 and 7 wherein said polyester fibre material is pre-heat shrunk to a substantially zero shrink value.

9. A fuse tube comprising the composition of claim 1.

10. A fuse tube comprising the multiple layered laminate of claim 6.

11. A fuse tube comprising the multiple layered laminate of claim 7.

12. The fuse tube of claim 9, 10 or 11, wherein said polyester fibre material is pre-heat shrunk to a substantially zero shrink value.

13. A fuse tube having a multiple layered laminate construction including:

an inner arc-quenching surface layer comprised of a wound filamentous heat-treated fibre material supported in a cycloaliphatic epoxy resin matrix; and, also including at least one other outer layer of filament wound glass fibre reinforced epoxy resin, said other layer being bonded to said surface layer.

14. The fuse tube of claim 13 wherein said surface layer and said at least one layer have been simultaneously cured.

15. The fuse tube of claim 13 wherein said polyester material is pre-heat shrunk to a substantially zero shrink value.

16. The fuse tube of claim 15 wherein said at least one other layer comprises a bisphenol-A epoxy resin.

17. The fuse tube of claim 15 wherein said at least one other layer comprises a cycloaliphatic epoxy resin.

18. The fuse tube of claim 13, wherein said surface layer comprises, by weight of said inner layer, 45 to 60 percent polyester fibre, 15 to 25 percent cycloaliphatic epoxy resin, and the balance including hardeners and catalysts.

19. The fuse tube of claim 18 wherein said surface layer comprises by weight of said inner layer, about 52.5 percent heat-treated polyester fibre, 22 percent cycloaliphatic epoxy resin, 25.4 percent anhydride hardener and 0.1 percent choline base catalyst.

20. The fuse tube of claims 13, 18 and 19 wherein said surface layer further includes a flame retarding amount of aluminum trihydrate.

* * * * *